United States Patent [19]

Kolbatz

[11] Patent Number: 4,853,691

[45] Date of Patent: Aug. 1, 1989

[54] METHOD OF AND APPARATUS FOR THE ACOUSTIC SIGNALLING OF CASES OF DROWNING IN SWIMMING POOLS

[76] Inventor: Klaus-Peter Kolbatz, Langenauer Weg 21, D-1000 Berlin 27, Fed. Rep. of Germany

[21] Appl. No.: 136,039

[22] Filed: Dec. 21, 1987

[30] Foreign Application Priority Data

Mar. 21, 1987 [DE] Fed. Rep. of Germany ..... 3709384

[51] Int. Cl.[4] ..... G08B 13/20

[52] U.S. Cl. ..... 340/566; 181/122; 181/402; 367/141; 367/173; 340/573; 340/693

[58] Field of Search ..... 340/565, 566, 573, 521, 340/531, 541, 384 E, 521, 610, 603, 693, 624, 625, 689; 367/107, 116, 141, 173, 176, 178, 191; 181/0.5, 402, 142, 122

[56] References Cited

U.S. PATENT DOCUMENTS

| | | | |
|---|---|---|---|
| 3,999,178 | 12/1976 | Hamilton | 340/689 |
| 4,121,200 | 10/1978 | Colmenero | 340/566 |
| 4,187,502 | 2/1980 | Beverly et al. | 340/566 |
| 4,536,747 | 8/1985 | Jensen | 340/531 |
| 4,641,127 | 2/1987 | Hogan et al. | 340/521 |
| 4,665,385 | 5/1987 | Henderson | 340/531 |

*Primary Examiner*—Glen R. Swann, III

*Attorney, Agent, or Firm*—Millen, White & Zelano

[57] ABSTRACT

The invention describes a method and apparatus for the acoustic signalling of cases of drowning in swimming pools, to guarantee reliable trigger of the alarm while avoiding any false alarms. This is effected basically by a switching element (1) in a water-tight encapsulation, which is disposed beneath the surface of the water and which, in the event of an alarm, triggers a first alarm device (2) and delivers an acoustic signal via a signal horn (5). A transmitter (6) is also connected to the alarm device (2) and transmits the alarm signal to a receiver at a distance and to another alarm device (10). Instead of the switching element (1), a microphone (12) can advantageously be used for cases in which the swimming pool water is frozen.

3 Claims, 2 Drawing Sheets

METHOD OF AND APPARATUS FOR THE ACOUSTIC SIGNALLING OF CASES OF DROWNING IN SWIMMING POOLS

BACKGROUND OF THE INVENTION

The invention relates to a method for the acoustic signalling when a person falls or jumps into a swimming pool.

In a known method of this kind, the movement of the surface of the water in the swimming pool is monitored by a vibration-sensitive switching element accommodated in a float, said switching element triggering an acoustic alarm outside the swimming pool via a cable link (DE-OS 27 43 192). The disadvantage of this method is that a relatively strong wind or branches, stones or other articles accidentally falling into the swimming pool trigger a false alarm, because the switching element floating on the surface of the water detects all surface movements and hence triggers the alarm already.

The object of the invention therefore is to provide a method and apparatus for performing this method to guarantee reliable triggering of the alarm in the event of a drowning person falling into the swimming pool and to prevent any false alarm.

SUMMARY OF THE INVENTION

The instant invention contemplates a system for monitoring a swimming pool having water therein to a selected surface level wherein the system activates an audible warning device in response to a person falling or jumping into the swimming pool. The system includes a hollow, frusto-conical disturbance collector having a first opening which is relatively wide and a second opening which is relatively narrow. The disturbance collector is positioned beneath the surface level of the water in the pool with the axis of the collector extending horizontally. The collector is positioned in spaced relation to the wall of the pool with the first end opening facing away from the wall and the second end opening facing the wall. A flap is pivoted by a horizontal hinge adjacent the second end opening of the collector and pivots upon impact by a submerged pressure wave generated upon a person jumping or falling into the pool. The flap is isolated from minor disturbances in the pool by the frusto-conical collector. The flap has a switching element secured thereto which generates a signal upon movement of the flap which signal activates an audible alarm.

In accordance with one embodiment of the invention, the switching element is a mercury tilt switch and in accordance with another embodiment of the invention, the switch is an encapsulated microphone which is used to detect breaking of ice formed on the pool surface in the winter.

BRIEF DESCRIPTION OF THE DRAWINGS

One exemplified embodiment of the invention is illustrated in the drawing and described in detail hereinafter. In the drawing.

DETAILED DESCRIPTION

Figure 1:
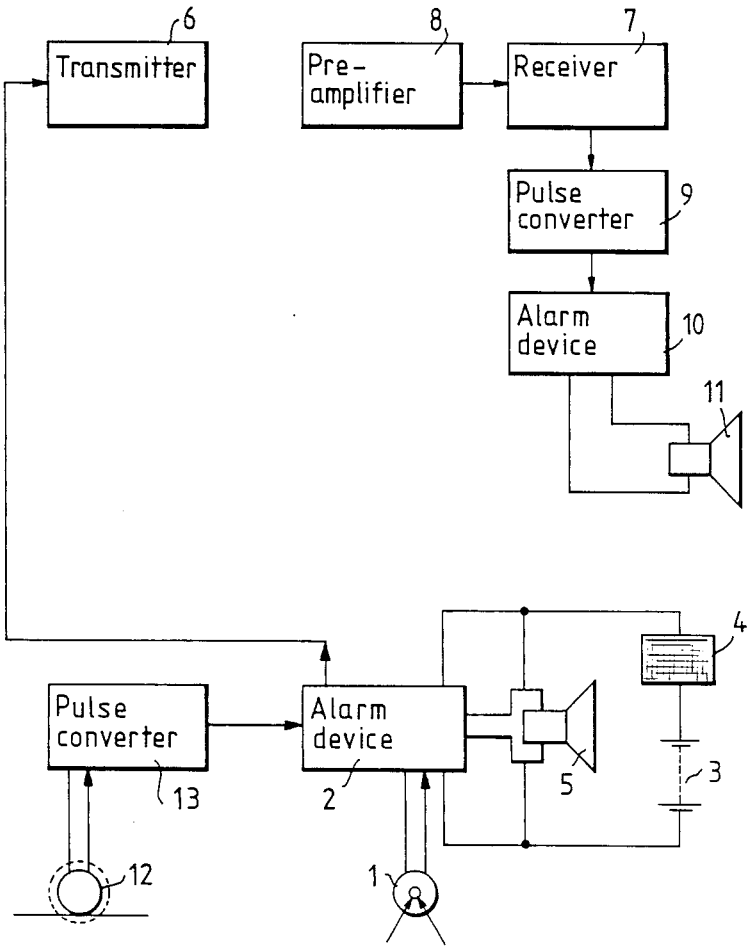
FIG. 1 is a block schematic showing a circuit arrangement for the method according to the invention and FIG. 2 diagrammatically illustrates apparatus for performing the method.

As will be seen from FIG. 1, the circuit arrangement for acoustic signalling of cases of a potential drowning in swimming pools as shown in the form of a block schematic consists of a switching element 1 which is fixed in the swimming pool beneath the surface of the water and which is connected to an alarm device 2 which is fed with a preferred operating voltage of 9 volts with a zero ampere quiescent current from an accumulator 3, the latter being chargeable during the day by means of solar cells 4. A signal horn 5 is connected to the alarm device 2 via a relay (not shown). If the alarm is triggered the relay switches and the signal horn 5 triggers an acoustic alarm. The alarm device 2 with the signal horn 5 is disposed outside the swimming pool, e.g., at the edge thereof. To enable an alarm to be received at a place which is at some distance from the swimming pool a transmitter 6 is connected to the alarm device 2 via a cable link and in the event of an alarm the alarm signal is transmitted by this to a receiver 7 at a distance, the alarm signal being amplified by a preamplifier 8. Another alarm device 10 with a signal horn 11 is connected to the receiver 7 via a pulse converter 9.

The above-described circuit arrangement can be used in water free of ice in the swimming pool 19. To enable the alarm device to be used operationally in the case of frozen water as well, according to the invention, instead of the switching element 1, a specially encapsulated microphone 12 is suspended in the water free of ice, and picks up the noise produced beneath or on the ice in the event of a person breaking into the ice, the noise then being processed as a signal in an electronic device and fed to the alarm devices 2 and 10 in the event of an alarm. In such cases, the sinusoidal oscillation produced in the event of a body falling into the frozen swimming pool is converted, by a pulse converter 13 following the microphone 12, into a rectangular pulse which triggers the alarm device 2 via a relay (not shown). At the same time, the alarm signal is transmitted to the remote receiver 7 via the transmitter 6 and to the alarm device 10 which triggers the alarm.

The transmitter may advantageously be an infrared device, an ultrasonic transmitter or a radio device. The receiver 7 may be connected to an existing house alarm system or to an independent alarm system installed in a motor vehicle or a caravan. It is also advantageous for the receiver 7 to be a microphone (not shown) disposed in a room in order to monitor the space for undesirables (persons breaking in).

To enable an alarm system to be used advantageously for the monitoring operation, the receiver 7 is, for example, connectable to a motor vehicle battery having a 12 volt operating voltage.

A smoke detector, temperature sensor or water detector may be connected to the receiver 7 according to the invention.

Figure 2:
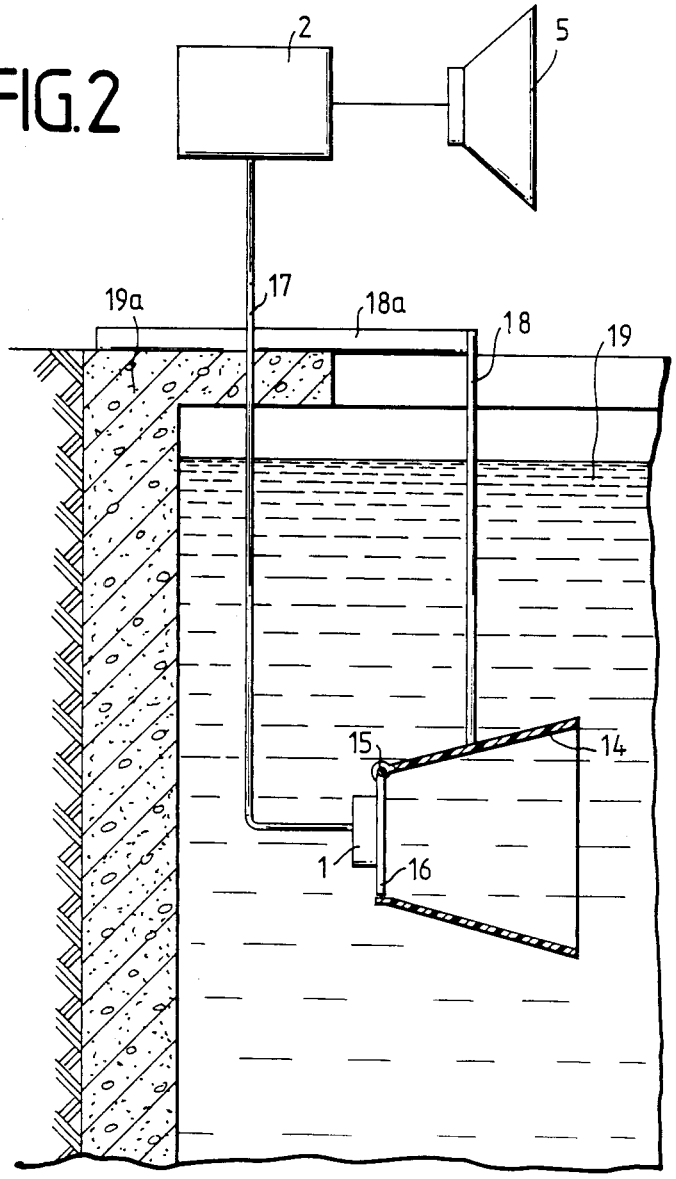

During periods when there is no ice, the encapsulated microphone 12 is replaced by a switching element 1. As will be apparent from FIG. 2, the switching element 1, which is encapsulated so as to be water-tight, is preferably disposed at the back of a flap 16 mounted to pivot about a spindle 15 perpendicularly to the surface of the water at the outlet of a funnel-shaped housing or frusto-conical shaped disturbance collector 14. The switching element 1 may be a mercury switch. The wave movement produced by a body falling into the swimming pool 19 is received in amplified form by the funnel 14 and imparts a pivoting movement to the flap 16 so that the mercury switch 1 switches the alarm system via a cable link 17 connected thereto and the signal horn 5 triggers an acoustic alarm. The funnel 14 immersed to an appropriate depth beneath the surface of the water in the swimming pool is secured to an angled structure 18, one angled part 18*a* of which is disposed at the edge 19*a* of the swimming pool. The axis of the collector extends horizontally with the wide end of the collector facing away from the wall and the smaller end of the collector facing the wall in spaced relation thereto. A false alarm triggered by strong winds or branches falling into the pool is precluded by the provision of the switching element 1 beneath the surface of the water. The construction of the funnel 14 in front of the flap 16 containing the switching element 1 guarantees reliable triggering of the switching element in the event of an alarm, because the underwater movement caused by the body is received in amplified and compressed form and directed on to the flap 16.

I claim:

1. A system for monitoring a swimming pool having water therein to a selected surface level, the system activating an audible warning device in response to a person jumping or falling into the swimming pool, the system comprising:

a hollow, frusto-conical disturbance collector having a first end opening which is relatively wide and a second end opening which is relatively narrow;

means for supporting the collector beneath the surface level of the water in the pool with the axis of the collector extending horizontally and the collector positioned in spaced relation to a wall of the pool with the first end opening facing away from the wall and the second end opening facing the wall;

a flap pivoted by a horizontal hinge adjacent the second end opening of the collector for pivoting upon impact by a submerged pressure wave generated upon a person jumping or falling into the pool, the flap being isolated by the frusto-conical collector from small surface disturbances created by leaves, stones or the like falling into the pool;

a switching element secured to the flap for emitting a signal upon moving with the flap;

circuit means connected to the switching element for detecting the signal; and alarm means connected to the circuit means for emitting an audible alarm upon the circuit means detecting the signal.

2. The system of claim 1, wherein the switching element is a mercury tilt switch which opens or closes contacts upon being tilted.

3. A system for monitoring a swimming pool having water therein to a selected surface level, the system activating an audible warning device in response to a person falling into the swimming pool, the system comprising:

a hollow, frusto-conical disturbance collector having a first end opening which is relatively wide and a second end opening which is relatively narrow;

means for supporting the collector beneath the surface level of the water in the pool with the axis of the collector extending horizontally and the collector positioned in spaced relation to a wall of the pool with the first end opening facing away from the wall and the second end opening facing the wall;

a flap pivoted by a horizontal hinge adjacent the second end opening of the collector for pivoting upon impact by a submerged pressure wave generated upon a person jumping or falling into the pool, the flap being isolated by the fursto-conical collector from small surface disturbances created by leaves, stones or the like falling into the pool;

an encapsulated microphone mounted on the flap for detecting noises in the water generated by breaking of ice and for emitting a signal upon detecting the noise;

circuit means connected to the switching element for detecting the signal; and alarm means connected to the circuit means for emitting an audible alarm upon the circuit means detecting the signal.

* * * * *